US005469666A

United States Patent [19]

Lewis, Jr.

[11] Patent Number: 5,469,666

[45] Date of Patent: Nov. 28, 1995

[54] WALKABLE SECURE PATIO DOOR THRESHOLD

[76] Inventor: William P. Lewis, Jr., 3229 Harbor View, Tampa, Fla. 33611

[21] Appl. No.: 304,926

[22] Filed: Sep. 13, 1994

[51] Int. Cl.[6] ..... E06B 1/70

[52] U.S. Cl. ..... 49/471; 49/467; 52/177; 52/207; 52/98; 52/730.6

[58] Field of Search ..... 49/471, 467, 505; 52/177, 179, 730.1, 730.3, 730.6, 98, 207, 204.51, 730.4, 730.5, 656.4, 656.5, 656.6, 656.2, 656.7

[56] References Cited

U.S. PATENT DOCUMENTS

| | | | |
|---|---|---|---|
| 578,273 | 3/1897 | Smith | 49/471 X |
| 3,008,198 | 11/1961 | Grunwald | 49/467 |
| 4,098,027 | 7/1978 | Crance | 49/504 |
| 4,922,661 | 5/1990 | Dallaire et al. | 49/467 X |
| 5,207,026 | 5/1993 | Bozeman, Jr. | 49/467 |
| 5,283,977 | 2/1994 | Smith | 49/469 X |
| 5,913,291 | 10/1995 | Dolien et al. | 52/177 X |

*Primary Examiner*—Lanna Mai
*Assistant Examiner*—Robert J. Canfield

[57] ABSTRACT

A new and improved walkable secure patio door threshold with a lower extrusion having a lower surface and a vertical extension. The lower surface has a plurality of apertures vertically therethrough. The vertical extension is integral with the lower surface of the lower extrusion. An upper extrusion has a plurality of guide grooves and a plurality of break grooves. Each of the guide grooves function to receive a sliding door. Each of the break grooves function to allow adjustment to accommodate a various number of sliding doors. A convoluted end portion is formed adjacent the sliding groove. A plurality of countersunk apertures are formed within the plurality of guide grooves. The countersunk apertures are aligned with the plurality of apertures formed in the lower surface of the lower extrusion for securement thereon.

6 Claims, 4 Drawing Sheets

WALKABLE SECURE PATIO DOOR THRESHOLD

BACKGROUND OF THE INVENTION

1. Field of the Invention

The present invention relates to a walkable secure patio door threshold and more particularly pertains to providing a patio door sill that is comfortable to the feet, can be walked upon, and is as theft proof as possible with a walkable secure patio door threshold.

2. Description of the Prior Art

The use of threshold systems is known in the prior art. More specifically, threshold systems heretofore devised and utilized for the purpose of providing a smooth sliding sill are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,098,027 to Crance discloses a sliding-door and sliding-screen sill.

U.S. Pat. No. 4,930,256 to Kawanishi discloses a method of smoothing the outer surface of structure with sliding doors and a sliding door with a mechanism for smoothing the outer surface.

U.S. Pat. No. 3,855,732 to Sheaf discloses a threshold strip for sliding doors having a replaceable bearing track.

U.S. Pat. No. 5,148,630 to Llorens discloses a security assembly for a sliding glass door.

U.S. Pat. No. 4,945,680 to Giguere discloses a threshold system for a domestic door.

While these devices fulfill their respective, particular objective and requirements, the aforementioned patents do not describe a walkable secure patio door threshold that provides a patio door sill that is comfortable to the feet, can be walked upon, and is as theft proof as possible.

In this respect, the walkable secure patio door threshold according to the present invention substantially departs from the conventional concepts and designs of the prior art, and in doing so provides an apparatus primarily developed for the purpose of providing a patio door sill that is comfortable to the feet, can be walked upon, and is as theft proof as possible.

Therefore, it can be appreciated that there exists a continuing need for a new and improved walkable secure patio door threshold which can be used for providing a patio door sill that is comfortable to the feet, can be walked upon, and is as theft proof as possible. In this regard, the present invention substantially fulfills this need.

SUMMARY OF THE INVENTION

In the view of the foregoing disadvantages inherent in the known types of threshold systems now present in the prior art, the present invention provides an improved walkable secure patio door threshold. As such, the general purpose of the present invention, which will be described subsequently in greater detail, is to provide a new and improved walkable secure patio door threshold and method which has all the advantages of the prior art and none of the disadvantages.

To attain this, the present invention essentially comprises a lower extrusion having a lower surface and a vertical extension. The lower surface has a plurality of apertures vertically therethrough. The vertical extension has a lower end and an upper end. The lower end is integral with one end of the lower surface of the lower extrusion. The device contains an upper extrusion having a plurality of guide grooves and a plurality of break grooves. The guide grooves have a vertical configuration and have a break groove positioned between each guide groove. The upper extrusion is removably positioned upon the upper end of the vertical extension of the lower extrusion. Each of the guide grooves function to receive a sliding door. A sliding groove is positioned adjacent the guide grooves. The sliding groove functions to accommodate a screen door with rollers. A convoluted end portion is formed adjacent the sliding groove. A plurality of countersunk apertures are formed within the plurality of guide grooves. The countersunk apertures are aligned with the plurality of apertures formed in the lower surface of the lower extrusion for securement thereon by a fastening means. A plurality of non-skid surfaces are secured to the upper flat surfaces of the upper extrusion. A plurality of drainage apertures are formed in the plurality of guide grooves of the upper extrusion. A plurality of snap-on covers are designed for removable positionment within the plurality of guide grooves of the upper extrusion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walkable secure patio door threshold which has all the advantages of the prior art threshold systems and none of the disadvantages.

It is another object of the present invention to provide a new and improved walkable secure patio door threshold which may be easily and efficiently manufactured and marketed.

It is a further object of the present invention to provide a new and improved walkable secure patio door threshold which is of durable and reliable construction.

An even further object of the present invention is to provide a new and improved walkable secure patio door threshold which is susceptible of a low cost of manufacture with regard to both materials and labor, and which accordingly is then susceptible of low prices of sale to the consuming public, thereby making such a walkable secure patio door threshold economically available to the buying public.

Still yet another object of the present invention is to provide a new and improved walkable secure patio door threshold which provides in the apparatuses and methods of the prior art some of the advantages thereof, while simultaneously overcoming some of the disadvantages normally associated therewith.

Even still another object of the present invention is to provide a new and improved walkable secure patio door threshold for providing a patio door sill that is comfortable to the feet, can be walked upon, and is as theft proof as possible.

Lastly, it is an object of the present invention to provide a new and improved walkable secure patio door threshold with a lower extrusion having a lower surface and a vertical extension. The lower surface has a plurality of apertures vertically therethrough. The vertical extension is integral with the lower surface of the lower extrusion. An upper extrusion has a plurality of guide grooves and a plurality of break grooves. Each of the guide grooves function to receive a sliding door. Each of the break grooves function to allow adjustment to accommodate a various number of sliding doors. A convoluted end portion is formed adjacent the sliding groove. A plurality of countersunk apertures are formed within the plurality of guide grooves. The countersunk apertures are aligned with the plurality of apertures formed in the lower surface of the lower extrusion for securement thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
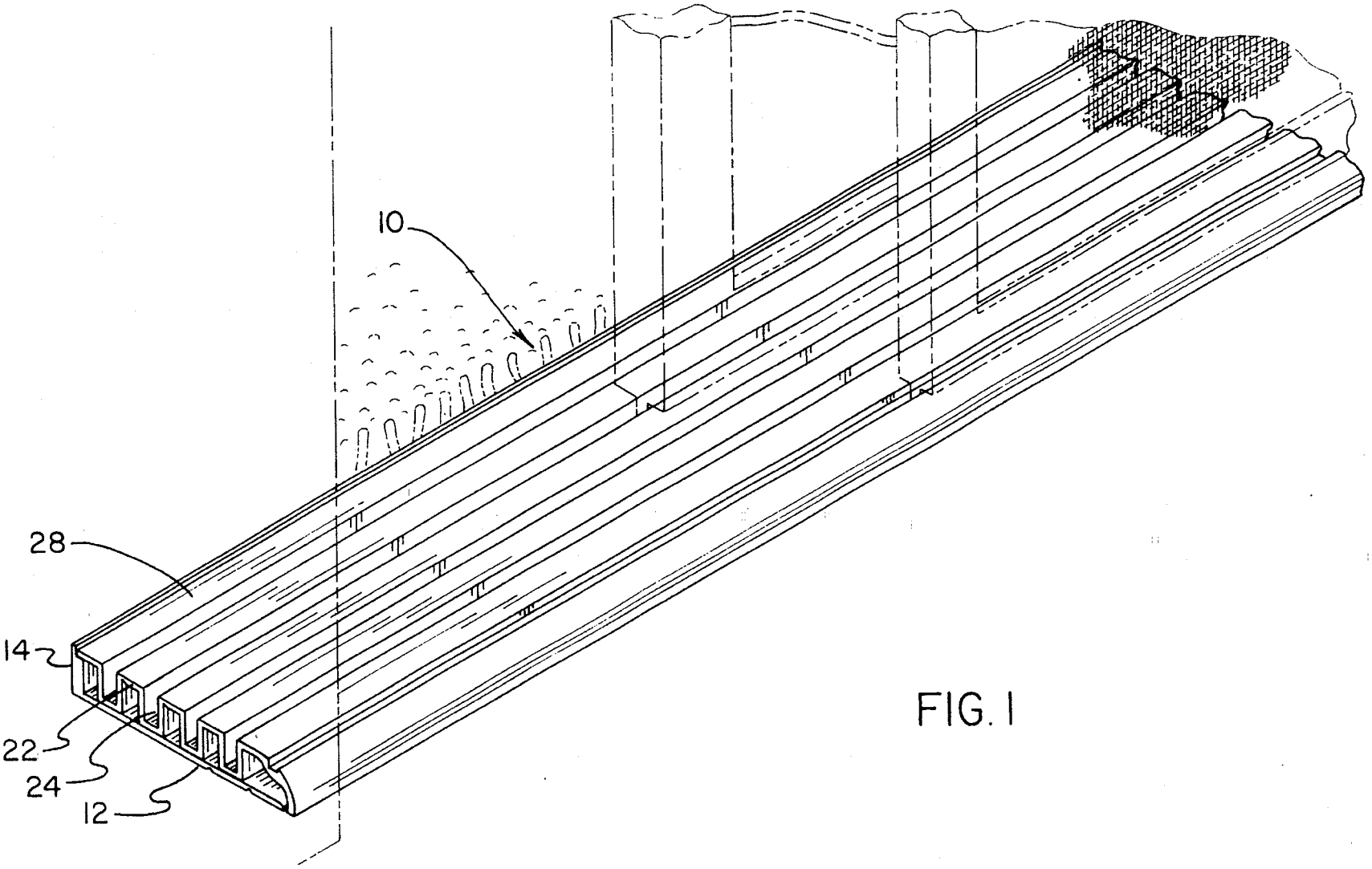
FIG. 1 is a perspective view of the preferred embodiment of the walkable secure patio door threshold constructed in accordance with the principles of the present invention.
Figure 2:
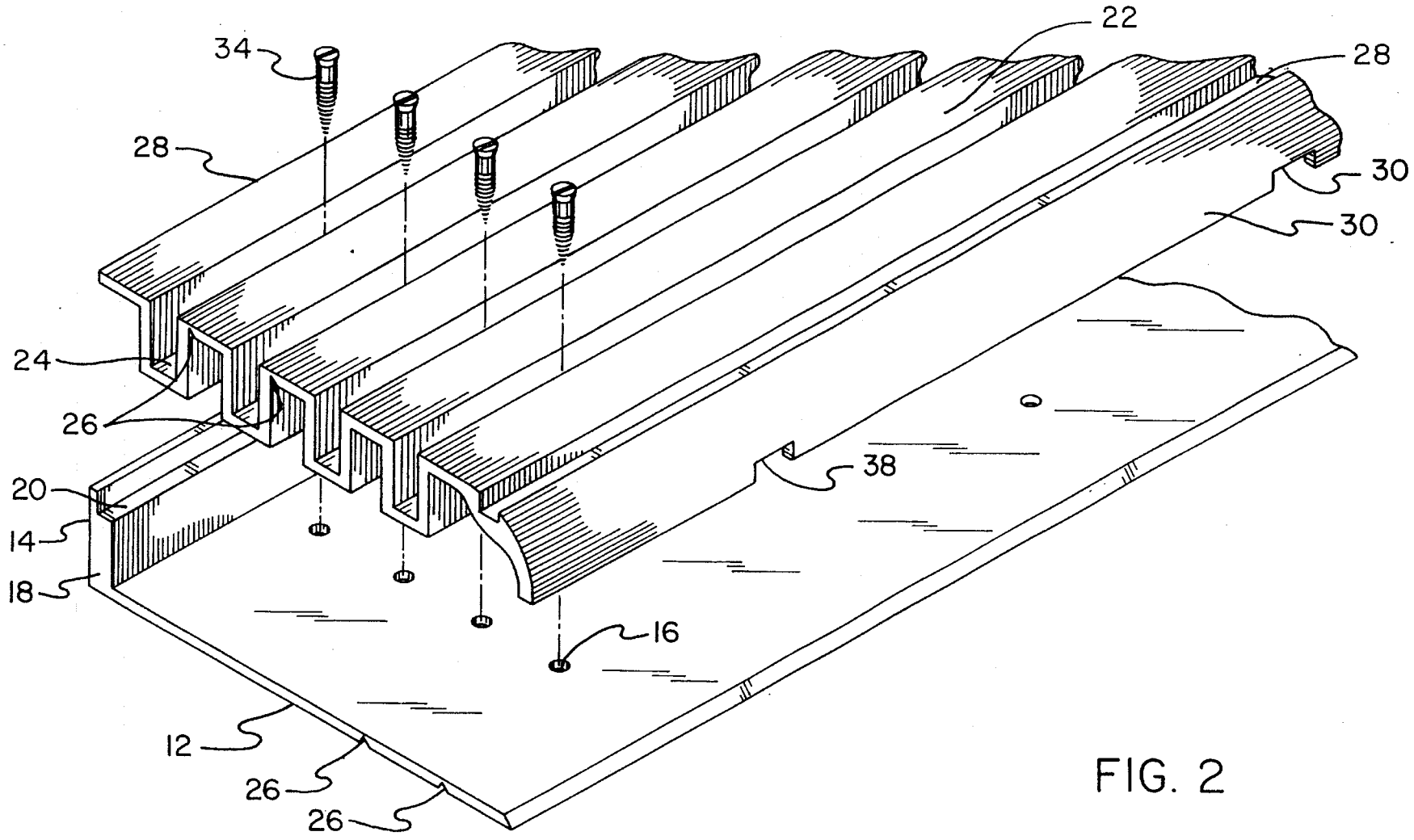
FIG. 2 is a partially segmented perspective view of the present invention showing both extrusions.
Figure 3:
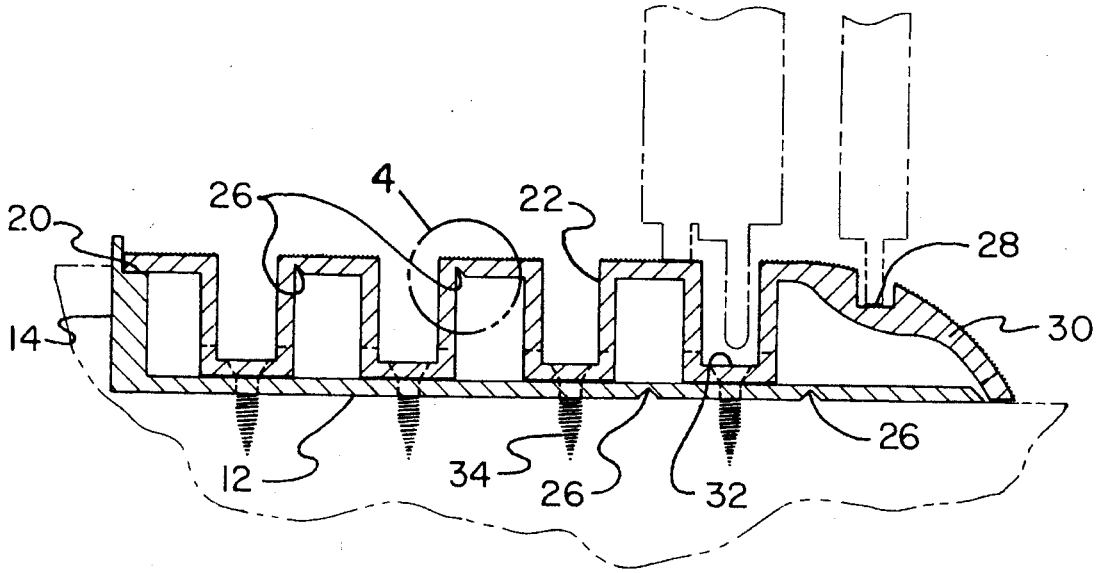
FIG. 3 is an enlarged side view of the present invention.
Figure 4:
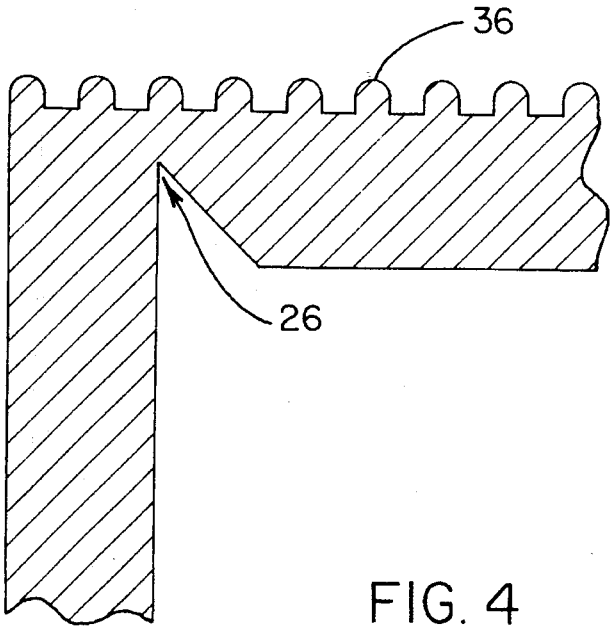
FIG. 4 enlarged view as seen along line 4 of FIG. 3.
Figure 5:
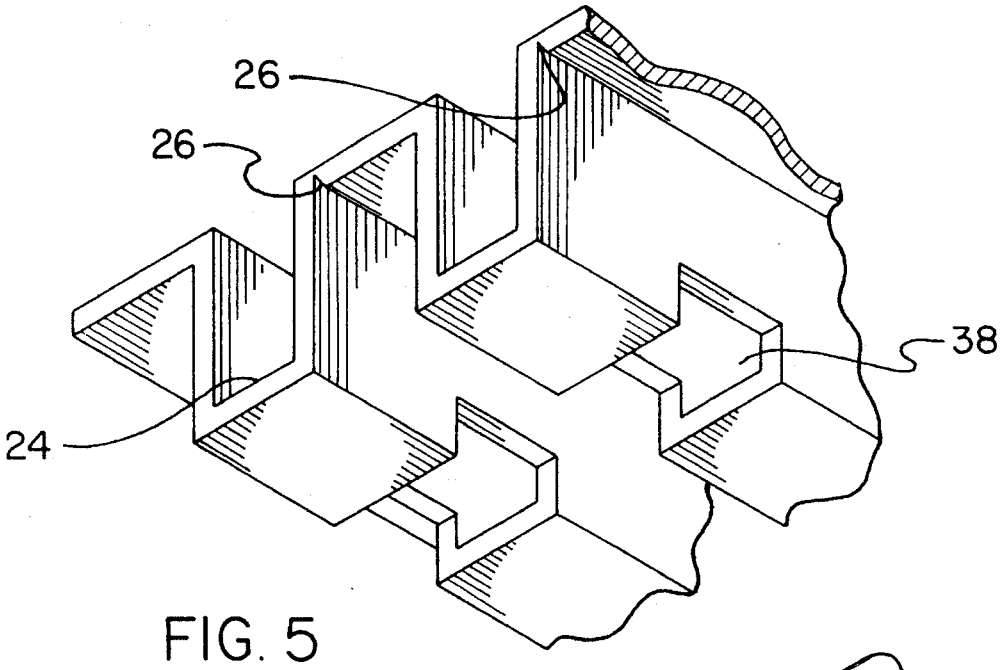
FIG. 5 is an enlarged view of the top extrusion of the present invention giving particular detail to the water drains.
Figure 6:
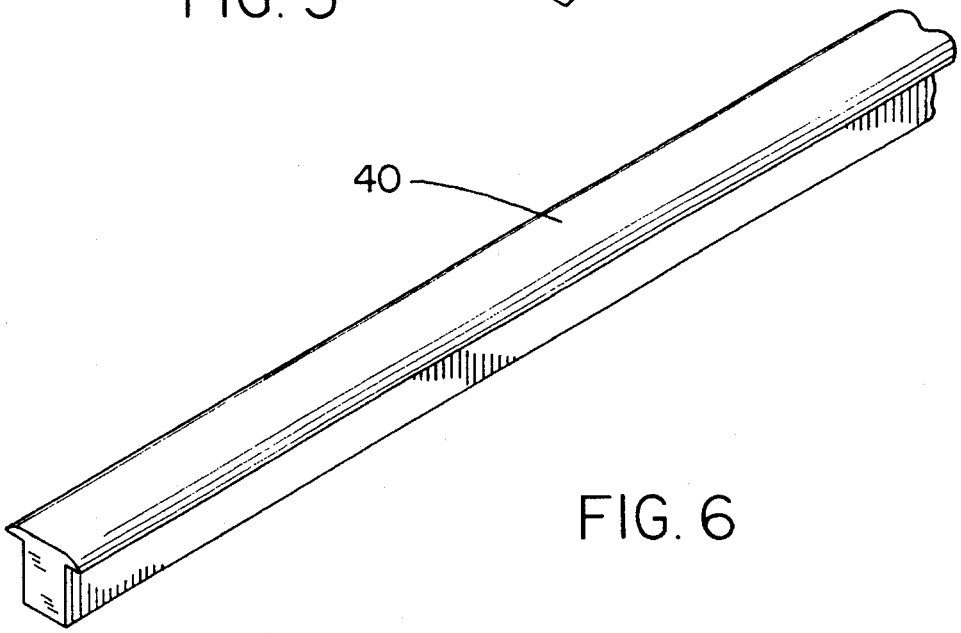
FIG. 6 is a perspective view of the snap-on covers of the present invention.
Figure 7:
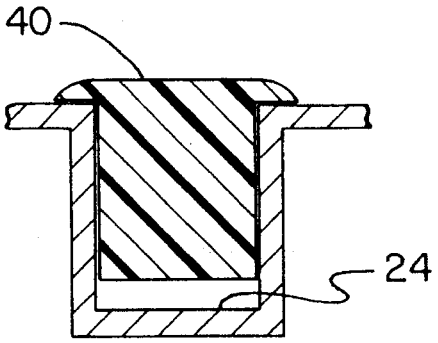
FIG. 7 is an enlarged side view of the snap-on covers in use on the top extrusion.

With reference now to the drawings, and in particular, to FIG. 1 thereof, the preferred embodiment of the new and improved walkable secure patio door threshold embodying the principles and concepts of the present invention and generally designated by the reference number 10 will be described.

Specifically, it will be noted in the various Figures that the device relates to a new and improved walkable secure patio door threshold for providing a patio door sill that is comfortable to the feet, can be walked upon, and is as theft proof as possible. In its broadest context, the device consists of a lower extrusion, an upper extrusion, a plurality of non-skid surfaces, a plurality of drainage apertures, and a plurality of snap-on covers.

The device 10 contains a lower extrusion 12 having a lower surface and a vertical extension 14. The lower surface has a plurality of apertures 16 vertically aligned therethrough. The vertical extension 14 has a lower end 18 and an upper end 20. The lower end 18 is integral with one end of the lower surface of the lower extrusion 12. The lower extrusion is comprised of aluminum so that it can be easily cleaned and easily manufactured.

The device 10 contains an upper extrusion 22 having a plurality of guide grooves 24 and a plurality of break grooves 26. The guide grooves 24 have a vertical configuration and have a break groove 26 positioned between each guide groove 24. Blades attached to the bottom of the sliding doors and projecting into the guide grooves 24 should run the entire length of the door to inhibit water and wind intrusion. The upper extrusion 22 is removably positioned upon the upper end 20 of the vertical extension 14 of the lower extrusion 12. Each of the guide grooves 24 function to receive a sliding door. Each of the upper flat surfaces of the upper extrusion 22 function to separate each sliding door positioned within the guide grooves 24. The break grooves 26 are incorporated to adjust widths for two, three, or four doors and allows for a universal manufacturing process for different sizes of thresholds. A sliding groove 28 is positioned adjacent the guide grooves 24. The sliding groove 28 functions to accommodate a screen door with rollers. A convoluted end portion 30 is formed adjacent the sliding groove 28. A plurality of countersunk apertures 32 are formed within the plurality of guide grooves 24. The countersunk apertures 32 are aligned with the plurality of apertures 16 formed in the lower surface of the lower extrusion 12 for securement thereon by a fastening means 34. The upper extrusion is a generally flat surface with open spaces in between for the doors. It presents a comfortable walking surface as opposed to other types of thresholds that have upwardly extending tracks for doors to slide which are uncomfortable to walk on. The upper extrusion, like the lower extrusion, is comprised of aluminum. The device also provides for a more difficult forced entry for intruders.

A plurality of non-skid surfaces 36 are secured to the flat upper surfaces and the convoluted end portion 30 of the upper extrusion 22. The surface 36 provides a safer area to walk upon, especially effective in a pool area where there is a lot of water to create a slippery surface.

A plurality of drainage apertures 38 are formed in the plurality of guide grooves 24 of the upper extrusion 22. The apertures 38 provide a method for water to be drained from within the guide grooves 24. Drainage apertures 38 are also positioned within the convoluted end portion 30.

A plurality of snap-on covers 40 are designed for removable positionment within the plurality of guide grooves 24 of the upper extrusion 22. The covers 40 should extend the entire unused length of the guide grooves 24 for cleanliness and appearance. The covers should also have a non-skid surface for a better walking surface.

A second embodiment of the present invention includes substantially all of the components of the present invention further including wherein the door threshold is a shower door, the type of shower door that slides.

The present invention is concealed below the surface so it can be walked upon, even when barefoot, without discomfort or tripping over projections. This feature makes it ideal for use on patio doors, particularly those that lead to a swimming pool. Patio doors are currently installed on sills which project a considerable amount above the floor. They also have guides and tracks upon which the doors slide. This arrangement requires stepping over them when passing through the openings. The design also has another very significant disadvantage. It is possible to lift the doors out of the tracks when standing on the outside. This is virtually an invitation to gain unauthorized entry into the home or building.

The invention consists of two extrusions, made of aluminum. One nests within the other, with both being flush with the floor. One extrusion forms the channel which is recessed and screwed into place. It is held in place by screws that fit into holes in the recess channel. These screws are concealed under the doors to prevent tampering. Strips can also be placed above the tops of the doors to ensure that they cannot be dislodged.

The present invention's design can be used on sills which contain any number of doors. The top surface has a non-skid pattern to prevent slipping when people have wet feet. Another application for these sills is on shower doors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved walkable secure patio door threshold for providing a patio door sill that is comfortable to the feet, can be walked upon, and is as theft proof as possible comprising, in combination:

a lower extrusion having a lower surface and a vertical extension, the lower surface having a plurality of apertures vertically therethrough, the vertical extension having a lower end and an upper end, the lower end integral with one end of the lower surface of the lower extrusion;

an upper extrusion having a plurality of guide grooves and a plurality of break grooves, the guide grooves having a vertical configuration and having a flat surface positioned between each guide groove, a first flat surface removably positioned upon the upper end of the vertical extension of the lower extrusion, each of the guide grooves functioning to receive a sliding door, each of the flat surfaces functioning to separate each sliding door adapted to be positioned within the guide grooves, a sliding groove positioned adjacent the guide grooves, the sliding groove functioning to accommodate a screen door with rollers, a convoluted end portion formed adjacent the sliding groove, a plurality of countersunk apertures formed within the plurality of guide grooves, the countersunk apertures aligned with the plurality of apertures formed in the lower surface of the lower extrusion for securement thereon by a fastening means;

a plurality of non-skid surfaces secured to the flat surfaces of the upper extrusion;

a plurality of drainage apertures formed in the plurality of guide grooves and the convoluted end of the upper extrusion; and a plurality of snap-on covers designed for removable positionment within the plurality of guide grooves of the upper extrusion.

2. A door threshold comprising:

a lower extrusion having a lower surface and a vertical extension, the lower surface having a plurality of apertures vertically therethrough, the vertical extension integral with the lower surface of the lower extrusion; and an upper extrusion having a plurality of guide grooves and a plurality of flat surfaces, each of the guide grooves functioning to receive a sliding door, each of the flat surfaces functioning to separate each sliding door adapted to be positioned within the guide grooves, a convoluted end portion formed adjacent the guide grooves, a plurality of countersunk apertures formed within the plurality of guide grooves, the countersunk apertures aligned with the plurality of apertures formed in the lower surface of the lower extrusion for securement thereon by a fastening means.

3. The apparatus as described in claim 2 and further comprising:

a sliding groove positioned adjacent the guide grooves of the upper extrusion, the sliding groove functioning to accommodate a screen door with rollers.

4. The apparatus as described in claim 3 and further comprising:

a plurality of non-skid surfaces secured to the flat surfaces of the upper extrusion.

5. The apparatus as described in claim 4 and further comprising:

a plurality of drainage apertures formed in the plurality of guide grooves and the convoluted end of the upper extrusion.

6. The apparatus as described in claim 5 and further comprising:

a plurality of snap-on covers designed for removable positionment within the plurality of guide grooves of the upper extrusion.

* * * * *